US005704321A

United States Patent [19]

Suckewer et al.

[11] Patent Number: 5,704,321

[45] Date of Patent: Jan. 6, 1998

[54] TRAVELING SPARK IGNITION SYSTEM

[75] Inventors: Szymon Suckewer; Enoch J. Durbin, both of Princeton, N.J.

[73] Assignee: The Trustees of Princeton University, Princeton, N.J.

[21] Appl. No.: 730,685

[22] Filed: Oct. 11, 1996

Related U.S. Application Data

60

Provisional application No. 60/018,534, May 29, 1996.

[51] Int. Cl.[6] ..... F02P 23/00

[52] U.S. Cl. ..... 123/143 B

[58] Field of Search ..... 123/143 B, 143 R, 123/146.5 R

[56] References Cited

U.S. PATENT DOCUMENTS

| | | | |
|---|---|---|---|
| 3,413,518 | 11/1968 | Chafer et al. | 315/180 |
| 4,122,816 | 10/1978 | Fitzgerald et al. | 123/148 |
| 4,366,801 | 1/1983 | Endo et al. | 123/620 |
| 4,369,756 | 1/1983 | Ezoe | 123/620 |
| 4,369,758 | 1/1983 | Endo | 123/620 |
| 4,398,526 | 8/1983 | Hamai et al. | 123/606 |
| 4,418,660 | 12/1983 | Endo et al. | 123/143 |
| 4,433,669 | 2/1984 | Ishikawa et al. | 123/620 |
| 4,448,181 | 5/1984 | Ishikawa et al. | 123/620 |
| 4,455,989 | 6/1984 | Endo et al. | 123/620 |
| 4,471,732 | 9/1984 | Tozzi | 123/143 B |
| 4,487,177 | 12/1984 | Ishikawa | 123/260 |
| 4,487,192 | 12/1984 | Anderson et al. | 123/654 |
| 4,677,960 | 7/1987 | Ward | 123/598 |
| 4,760,820 | 8/1988 | Tozzi | 123/143 B |
| 4,766,855 | 8/1988 | Tozzi | 123/143 B |
| 4,774,914 | 10/1988 | Ward | 123/162 |
| 4,805,570 | 2/1989 | Davis | 123/310 |
| 4,841,925 | 6/1989 | Ward | 123/143 |
| 4,930,473 | 6/1990 | Dietrich | 282/74 |

(List continued on next page.)

OTHER PUBLICATIONS

R.D. Matthews et al., "Further Analysis of Railplugs as a New Type of Ignitor", *SAE* 922167 (1992), pp. 1851–1862.

R.M. Clements et al., "An Experimental Study of the Ejection Mechanism for Typical Plasma Jet Igniters", *Combustion and Flame* 42: 287–295 (1981).

Rudolf Maly, "Ignition Model for Spark Discharges and the Early Phase of Flame Front Growth", *Eighteenth Symposuim (International) on Combustion*, pp. 1747–1754, The Combustion Institute, 1981.

Ather A. Quader, "How Injector, Engine, and Fuel Variables Impact Smoke and Hydrocarbon Emissions with Port Fuel Injection", *Society of Automotive Engineers, Inc.*, pp. 1–23, Copyright 1989 No.890623.

D. Bradley and I.L. Critchley, "Electromagnetically Induced Motion of Spark Ignition Kernels", *Combustion and Flame* 22, 143–152 (1974).

M.J. Hall et al., "Initial Studies of a New Type of Ignitor: The Railplug", *SAE* 912319 pp. 1730–1746 (1991).

*Primary Examiner*—Raymond A. Nelli

*Attorney, Agent, or Firm*—Watov & Kipnes, P.C.

[57] ABSTRACT

A plasma injector for an internal combustion engine, in one embodiment, includes two spaced apart and parallel donut shaped disk electrodes, between which a horizontally outward moving plasma is formed via a high voltage applied across the electrodes. The present invention is characterized by its efficient use of input electrical energy via electronic circuitry for driving the plasma injector. An ignition source provides an ignition plasma kernel which is several orders of magnitude larger than that produced by conventional spark plugs.

Use of very lean combustible mixtures, in which the dilution of the mixture is achieved by use of exhaust gas recirculation, is made possible by the present ignition system. Considerable improvement in engine efficiency, and a major reduction in $NO_x$ exhaust gas pollutants are obtained via the present ignition.

10 Claims, 7 Drawing Sheets

U.S. PATENT DOCUMENTS

| | | | |
|---|---|---|---|
| 4,996,967 | 3/1991 | Rosswurm et al. | 123/598 |
| 5,007,389 | 4/1991 | Kashiwara et al. | 123/169 |
| 5,076,223 | 12/1991 | Harden et al. | 123/143 |
| 5,131,376 | 7/1992 | Ward et al. | 684/595 |
| 5,197,448 | 3/1993 | Porreca et al. | 123/620 |
| 5,207,208 | 5/1993 | Ward | 123/596 |
| 5,211,142 | 5/1993 | Matthews et al. | 123/143 B |
| 5,215,066 | 6/1993 | Narishige et al. | 123/620 |
| 5,228,425 | 7/1993 | Simons | 123/620 |
| 5,377,633 | 1/1995 | Wakeman | 123/297 |
| 5,423,306 | 6/1995 | Trigger et al. | 123/637 |
| 5,456,241 | 10/1995 | Ward | 173/598 |
| 5,513,605 | 5/1996 | Weldon | 123/143 B |
| 5,555,862 | 9/1996 | Tozzi | 123/143 B |
| 5,619,959 | 4/1997 | Tozzi | 123/143 B |

TRAVELING SPARK IGNITION SYSTEM

RELATED APPLICATION

The application is related to Provisional application Ser. No. 60/018,534, filed on May 29, 1996, for TRAVELING SPARK IGNITION SYSTEM.

FIELD OF THE INVENTION

The field of this invention relates generally to internal combustion engine ignition systems, including the associated firing circuitry.

BACKGROUND OF THE INVENTION

Ignition systems, and especially spark plugs, in current automobiles are not much different from earlier ones, and not much use has been made of the knowledge of plasmas.

Automobiles have undergone many changes since their initial development at the end of the last century. Many of these evolutionary changes can be seen as a maturing of technology, with the fundamental principles remaining the same. Such is the case with the ignition system. Some of its developments include the replacement of mechanical distributors by electronic ones, increasing reliability and allowing for easy adjustment of the spark timing under different engine operating conditions. The electronics responsible for creating the high voltage required for the discharge have changed, with transistorized coil ignition (TCI) and capacitive discharge ignition (CDI) systems common today. However, the basic spark plug structure has not changed. Spark plugs today differ from earlier ones mostly in the use of improved materials, but the basic point-to-point discharge remains the same.

In current ignition systems, only a very small fraction of electric energy (about 3%) is converted into plasma that is used in igniting the combustible mixture (Maly, R., "Spark Ignition: Its Physics and Effect on the Internal Combustion Engine", Ed.: Hillard, J. C., & Springer, C. S., "Fuel Economy: Road Vehicles Powered by Spark Ignition Engines", Plenum Press (1984)). Well meaning, but largely unsuccessful, attempts have been made to improve on this fraction. For example, a spark driven by the force from the interaction of the magnetic field created by the spark current and the current itself is very attractive concept, known in the literature for a number of years.

Thus the concept of this invention is not new. The need for an enhanced ignition source has long been recognized. Many inventions have been made which provide enlarged ignition kernels. The use of plasma jets and Lorentz force plasma accelerators have been the subject of much study and patents. None of these prior inventions have resulted in practical commercially acceptable solutions. The primary weaknesses of the prior inventions have been the requirement for excessive ignition energy which eliminates any possible efficiency enhancement in the engine in which they are employed. These higher ignition energy requirements have resulted in high rates of ignition electrode erosion, which reduces ignition operating life to unacceptable levels.

The concept of enlarging the volume and surface area of the spark initiated plasma ignition kernel is an attractive idea for extending the practical lean limit for combustible mixtures in a combustion engine. The objective is to reduce the variance in combustion delay which is typical when engines are operated with lean mixtures. More specifically, there has been a long felt need to eliminate ignition delay, by increasing the spark volume. While it will be explained in more detail below, note that if a plasma is confined to the small volume between the discharge electrodes (as is the case with a conventional spark plug), its initial volume is quite small, typically about 1 $mm^3$ of plasma having a temperature of 60,000° K is formed. This kernel expands and cools to a volume of about 25 $mm^3$ and a temperature of 2,500° K, which can ignite the combustible mixture. This volume represents about 0.04% of the mixture that is to be burned to complete combustion in a 0.5 liter cylinder at a compression ration of 8/1. From the discussion below it will be seen that, if the ignition kernel could be increased 100 times, 4% of the combustible mixture would be ignited and the ignition delay would be practically eliminated. This attractive ignition concept has not been adopted in practical systems. The reason is clear when one examines the energy required to obtain the enhanced ignition performance provided by these earlier systems.

The electrical energy required in these earlier systems, i.e. Fitzgerald et al., U.S. Pat. No. 4,122,816 is claimed to be more than 2 Joules per firing (col. 2, lines 5563). This energy is about 40 times higher than that used in conventional spark plugs.

Matthews et al., infra, reports the use of 5.5 Joules of electrical energy per ignition, or more than 100 times the energy used in conventional ignition systems.

Consider a six cylinder engine operating at 3600 RPM, which requires firing three cylinders every engine revolution or 180 firings per second, or over 360 Joules/second. This energy must be provided by the combustion engine at a typical efficiency of about 18% and converted to a suitable higher voltage by power conversion devices with a typical efficiency of about 40% for a net use of the engine fuel at an efficiency of about 7.2%. Fitzgerald requires a fuel consumption of 360/0.072 Joules/second, or about 5000 Joules/second to run the ignition system.

How this compares with the fuel energy required to provide the motive force to operate the vehicle will now be explained. To move a 1250 kg vehicle on a level road at about 80 km/hr (about 50 mph) requires about 9000 Joules/second of fuel energy. At an engine fuel to motive force conversion efficiency of 18%, about 50,000 Joules/second of fuel will be consumed. Thus the system employed by Fitzgerald, et al., infra, will consume about 10% of the fuel energy to run the ignition system. This is probably greater than the efficiency gain to be expected by use of the Fitzgerald et al., infra, ignition systems.

This is to be compared with conventional ignition systems which use about 0.25 percent of the fuel energy to run the ignition system. Further, the high energy employed in these systems causes high levels of erosion to occur in the electrodes of the spark plugs, thus reducing the useful operating life considerably. This shortened life is demonstrated in the work by Matthews et at., infra, where the need to reduce ignition energy is acknowledged although no solution is provided.

As an additional attempt at solving this problem, consider the work by Tsao and Durbin (Tsao, L. and Durbin, E. J., "Evaluation of Cyclic Variation and Lean Operation in an Combustion Engine with a Multi-Electrode Spark Ignition System", *Princeton Univ., MAE Report*, (January, 1984)), where a larger than regular ignition kernel was generated by a multiple electrode spark plug, demonstrating a reduction in cyclic variability of combustion, a reduction in spark advance, and an increase in output power. The increase in kernel size was only six times that of an ordinary spark plug.

Bradley and Critchley (Bradley, D., Critchley, I. L., "Electromagnetically Induced Motion of Spark Ignition Kernels", *Combust. Flame* 22, pgs. 143–152 (1974)) were the first to consider the use of electromagnetic forces to induce a motion of the spark, with an ignition energy of 12 Joules. Fitzgerald (Fitzgerald, D. J., "Pulsed Plasma Ignitor for Internal Combustion Engines", *SAE paper* 760764 (1976); and Fitzgerald, D. J., Breshears, R. R., "Plasma Ignitor for Internal Combustion Engine", U.S. Pat. No. 4,122,816 (1978)) proposed to use pulsed plasma thrusters for the ignition of automotive engines with much less but still substantial ignition energy (approx. 1.6 J). Although he was able to extend the lean limit, the overall performance of such plasma thrusters used for ignition systems was not significantly better than that of regular sparks. In this system much more ignition energy was used without a significant increase in plasma kernel size. (Clements, R. M., Smy, P. R., Dale, J. D., "An Experimental Study of the Ejection Mechanism for Typical Plasma Jet Ignitors", *Combust. Flame* 42, pages 287–295 (1981)). More recently Hall et al. (Hall, M. J., Tajima, H., Matthews, R. D., Koeroghlian, M. M., Weldon, W. F., Nichols, S. P., "Initial Studies of a New Type of Ignitor: The Railplug", *SAE paper* 912319 (1991)); and Matthews et al. (Matthews, R. D., Hall, M. J., Faidley, R. W., Chiu, J. P., Zhao, X. W., Annezer, L., Koening, M. H., Harber, J. F., Darden, M. H., Weldon, W. F., Nichols, S. P., "Further Analysis of Railplugs as a New Type of Ignitor", *SAE paper* 922167 (1992)), have shown that a "rail plug" operated at an energy of over 6 J (2.4 cm long) showed a very substantial improvement in combustion bomb experiments. They also observed improvements in the lean operation of an engine when they ran it with their spark plug at an ignition energy of 5.5 J. They attributed the need of this excessive amount of energy to poor matching between the electrical circuit and the spark plug. It is important to note that this level of energy expended in the spark plug is about 25% of the energy consumed in propelling a 1250 kg vehicle at 80 KM/HR on a level road. Any efficiency benefits in engine performance would be more than consumed by the increased energy in the ignition system.

SUMMARY OF THE INVENTION

The invention is a traveling spark ignition (TSI, this acronym will also be used herein to stand for traveling spark ignitor, depending on the context) system that uses a miniature plasma injector (plasma Marshall gun) as an ignitor, which provides a volume of plasma which is at least two orders of magnitude larger than that of a conventional spark plug, in combination with matching circuitry to provide high efficiency in convening electrical energy into plasma volume. This is the core idea of The Invention. This larger plasma volume has a very positive effect on an internal combustion engine: it can lead to an increase in the efficiency of the engine and a decrease in the level of pollutants. The invention also comprises a new ignitor, which forms the plasma as a electromagnetically driven radially expanding torus, as opposed to the axial traveling plasma of the prior art.

With the problems of the prior art in mind, an object of the invention is to provide a new ignition system with improved ignition performance and far more efficient use of the electrical energy in the ignitor.

Another object of the invention is to provide a dramatic enlargement of the volume and surface area of spark initiated plasma ignition kernels.

Another object of the invention is to provide for high plasma volume from the ignition device in a highly efficient fashion.

Another object of the invention is to provide for a traveling spark ignition system that achieves its improvements in engine performance using low energy levels.

Another object of the invention is to provide for a practical ignition system that benefits the environment by providing a method for reducing nitric oxide ($NO_x$) and hydrocarbon (HC) emissions.

These and other objects of the invention are provided by an improved TSI system which yields a high volume ignition plasma, with an efficient use of input electrical energy.

TSI has solved the problems in the prior art, by five fundamental enhancements in the design of the ignition system.

1. The main plasma forming technique is to use a very low voltage, high capacitance discharge, which for a given energy gives maximum Q. Higher the Q, the larger the mass ionized.
2. To achieve this the inventors create a charge on the insulator separating the discharge electrodes in order to lower the surface resistivity. They do this efficiently by not using a trigger spark in air, but rather a trigger discharge on the insulator surface.
3. The duration of discharge is very important in increasing efficiency. First, a short time discharge lowers heat losses in the electrode (breakdown discharge). Second, a short time discharge reduces the probability of recombination plasma losses.
4. The inventors discovered how to create a lower plasma velocity to reduce drag losses as the plasma intrudes into the combustible mixture (drag increases as plasma velocity squared).
5. These four enhancements are combined, in one embodiment of the invention, with Lorentz force plasma propulsion to enlarge the plasma volume and to reduce electrode erosion by moving the locus of the plasma formation point.

BRIEF DESCRIPTION OF THE DRAWINGS

Various embodiments of the invention are illustrated and described below with reference to the accompanying drawings, in which like items are identified by the same reference designation, wherein.

DETAILED DESCRIPTION OF THE INVENTION

Figure 2:
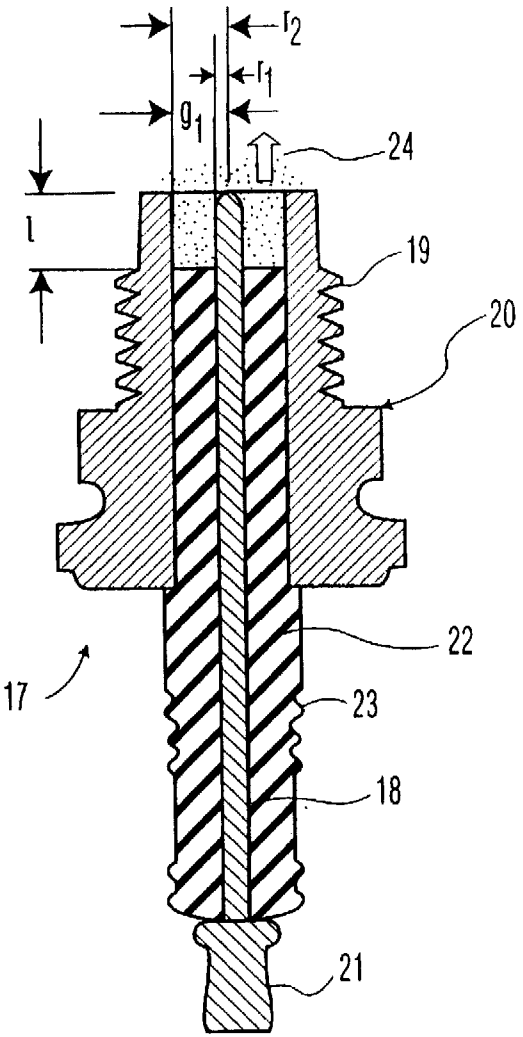
FIG. 2 is a cross sectional view of a traveling spark ignitor for one embodiment of this invention, including two electrodes and wherein the plasma produced travels by expanding in the axial direction.

The invention is a traveling spark initiator or ignitor (TSI) in the form of a miniature Marshal gun (coaxial gun), wherein the efficiency of transfer of electric energy into plasma is considerably higher than that achieved before. In the embodiment of FIG. 2 a ratio of a sum of the radii ($r_2$) and ($r_1$), of an external electrode and internal electrode, respectively, to the length (l) of the electrodes should be larger than or equal to 4, whereas the ratio of the difference of these two radii ($r_2$–$r_1$) to the length (l) of the electrodes should be larger than ⅓ (preferable larger than ½) as follows:

$$\frac{r_2+r_1}{l} \geqq 4 \quad \text{and} \quad \frac{r_2-r_1}{l} > \frac{1}{3} \tag{1}$$

Figure 3:
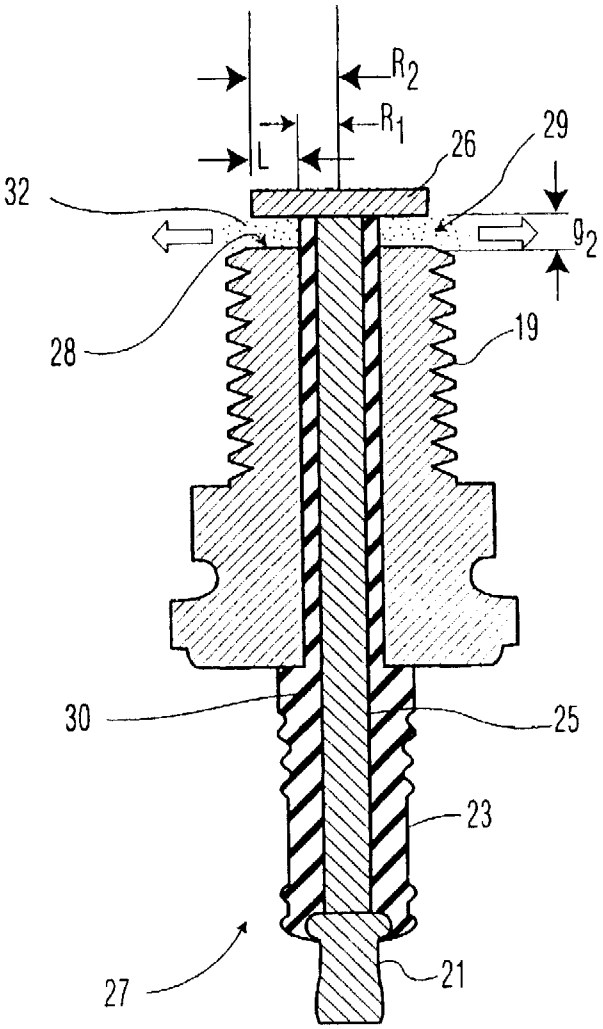
FIG. 3 is a cross sectional view of a traveling spark ignitor for another embodiment of the invention including two electrodes and wherein the plasma produced travels by expanding in the radial direction.

Similar relations are required for the embodiment of FIG. 3, where $R_2$ and $R_1$ are replacing $r_2$ and $r_1$ from FIG. 2, the gap between the electrodes is $g_2$ and the length of the electrodes is L. Hence $$\frac{R_2+R_1}{L} \geqq 4 \quad \text{and} \quad \frac{g_2}{L} > \frac{1}{3} \tag{2}$$

The associated electric circuitry of TSI maximizes the acceleration of the plasma along the length of the electrodes (6 in FIG. 2 and L in FIG. 3). The resulting ignition system has a much larger plasma volume than the plasma created in a conventional spark plug; more than 100 times larger. The heat transfer to the combustible mixture occurs in the form of the diffusion of ions and radicals from the plasma. The very large increase in plasma volume dramatically increases the rate of heat transfer to the combustible mixture.

The principle of the Marshall gun is discussed first. This leads to a discussion of the environmental benefits that would be expected if a ignition system, with larger spark volumes were constructed. The construction details of such a system will be discussed relative to various embodiments of the invention.

Figure 1:
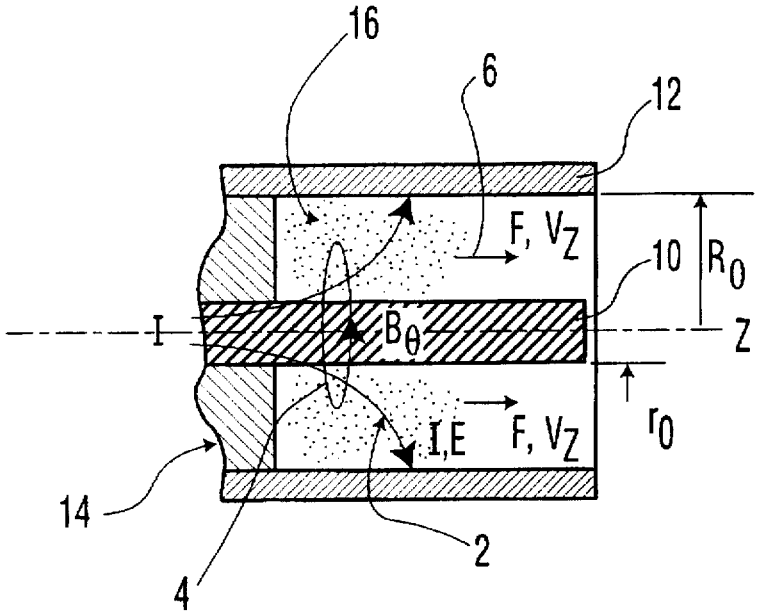
FIG. 1 is a cross sectional view of a Marshall gun with a pictorial illustration of its operation, which is useful in understanding the invention.

The principle of the Marshall gun presents an effective way of creating a large volume of plasma. With reference to FIG. 1, the plasma 16 is moved in a direction 6 by the action of the Loreritz force F and thermal expansion, with new plasma being continually created by the breakdown of fresh gas as the plasma moves into it. Thus the plasma 16 grows as it moves along and through the space between electrodes 10, 12. Once the plasma 16 leaves the electrodes 10, 12, it grows further through thermal expansion, cooling in the process. As it expands and cools, it expands in volume. It ignites the combustibles mixture after it has cooled to the ignition temperature.

The schematic presentation in FIG. 1 shows the electric field 2 and magnetic field 4 in an illustrative coaxial plasma gun, where $B_T$ is the poloidal magnetic field directed along field line 4. F is the Lorentz force vector as shown by arrow 6. $V_z$ is the plasma kernel speed vector, also directed along and represented by arrow 6. The internal and external electrodes are 10 and 12, respectively, 14 is an isolator or dielectric, and 16 represents the plasma.

The anticipated environmental benefits will now be discussed. The importance of an increase in spark volume becomes clear when the strategies for reduction of emissions and improvement of fuel economy are considered. Two such strategies are to increase the dilution of the gas mixture inside the cylinder and to reduce the cycle-to-cycle variations (Tsao, L. and Durbin, E. J., "Evaluation of Cyclic Variation and Lean Operation in an Combustion Engine with a Multi-Electrode Spark Ignition System", *Princeton Univ., MAE Report* (January, 1984)).

Dilution of the gas mixture, which is most commonly achieved by the use of either excess air (running the engine lean) or exhaust gas recirculation (EGR), reduces the formation of oxides of nitrogen by lowering the combustion temperature. Oxides of nitrogen play a critical role in the formation of smog, and their reduction is one of the continuing challenges for the automotive industry. Dilution of the gas mixture also increases the fuel efficiency by reducing the heat loss, through the combustion chamber walls, improving the ratio of specific heats, and by lowering the pumping losses at a partial load.

Zeilinger determined the nitrogen oxide formation per horsepower-hour of work done, as function of the air to fuel ratio, for three different spark timings (Zeilinger, K., Ph.D. thesis, Technical University of Munich (1974)). The engine speed used was 2500 rpm. He found that both the air to fuel ratio, and the spark timing affect the combustion temperature, and thus the nitrogen oxide formation. As the combustible mixture or air/fuel ratio (A/F) is diluted with excess air (A/F larger than stoichiometric), the temperature drops. At first, this effect is diminished by the increase in the amount of oxygen. The $NO_x$ formation increases. When the mixture is further diluted, the $NO_x$ formation decreases to values much below those at a stoichiometric mixture because the combustion temperature decline overwhelms the increase in $O_2$.

A more advanced spark timing (more degrees before top dead center) raises the peak temperature and decreases engine efficiency because a larger fraction of the combustible mixture burns before top dead center (TDC) and is compressed to a higher temperature, hence leading to much higher $NO_x$ levels and heat losses. As the mixture is made lean, the spark timing, which gives the maximum brake torque (MBT timing), increases.

Dilution of the mixture results in the reduction of the energy density and the flame propagation speed, which affect ignition and combustion. The lower energy density reduces the heat released from the chemical reaction within a given volume, and thus shifts the balance between the chemical heat release and the heat lost to the surrounding gas. If the heat release is less than that lost, the flame will not propagate. An increase in the ignition volume will shift the balance towards the released heat by reducing the required spark advance. The increase in ignition volume is required to assure that the flame propagation does not slow down as the energy density of the combustible mixture is reduced (Maly, R., "Spark Ignition: Its Physics and Effect on the Internal Combustion Engine", Ed.: Hillard, J. C., & Springer, C. S., "Fuel Economy: Road Vehicles Powered by Spark Ignition Engines", Plenum Press (1984)).

A reduction in the flame propagation speed increases the combustion duration. Ignition delay results from the fact that the flame front is very small in the beginning, which causes it to grow very slowly, as the combustion rate is proportional to the surface area. The increase in the ignition delay and the combustion duration results in an increase of the spark advance required for achieving the maximum torque and reduces the output work. A larger ignition kernel will reduce the advance in spark timing required, and thus lessen the adverse effects associated with such an advance. (These adverse effects are an increased difficulty to ignite the combustible mixture, due to the lower density and temperature at the time of the spark, and an increase in the variation of the ignition delay, which causes driveability to deteriorate).

The increase in the combustion duration due to dilution can be lessened by enhancing the turbulence level in the combustion chamber. Enhanced turbulence increases the burning rate of the combustible mixture, but it also negatively affects ignition through a rise in heat loss. (This adverse effect of turbulence on ignition is similar to the increased difficulty of lighting a candle in the wind). The negative effect of turbulence on ignition can be compensated for by an increase in the spark volume.

Cyclic variations are caused by unavoidable variations in the local air-to-fuel ratio, temperature, amount of residual gas, and turbulence. The effect of these variations on the cylinder pressure is largely due to their effect on the initial expansion velocity of the flame. This effect can be significantly reduced by providing a spark volume which is appreciably larger than the mean sizes of the inhomogeneities.

A decrease in the cyclic variations of the engine will reduce emissions and increase efficiency, by reducing the number of poor burn cycles, and by extending the operating air fuel ratio range of the engine, which is limited by the worst cycles.

Quader, supra, determined the mass fraction of the combustible mixture which was burned as a function of the crank angle, for two different spark timings (Quader, A., "What Limits Lean Operation in Spark Ignition Engines—Flame Initiation or Propagation?", *SAE Paper* 760760 (1976)). His engine was running very lean (equivalence ratio of about 0.7), at 1200 rpm and at 60% throttle. The mass fraction burned did not change in any noticeable way immediately after the spark occurred (there is an interval where hardly any burning can be detected which is commonly known as the ignition delay). This is due to the very small volume of the spark, and the slow combustion duration due to the small surface area and relatively low temperature. Once a small percentage of the combustible mixture has burned, the combustion rate increases, slowly at first, and then more rapidly as the flame front grows. The performance of the engine at both of these spark timings is poor. In the case of 60° B.T.D.C. (Before top dead center), too much of the mixture has burned while the piston is compressing the mixture, and, therefore, negative work is being done. The rise in pressure is opposing the compression strokes of the engine. In the case of the 40° B.T.C.D., a considerable fraction of the mixture is burned after the expansion strokes had started thus reducing the output work.

The intersection of a 4% burned line with the curves determined by Quader, Id., shows the potential advantage that a large spark volume, if available, would have in eliminating the ignition delay. For the 60° B.T.D.C. spark curve, if the spark timing is changed from 60° to 22° B.T.D.C., a change of nearly 40 degrees. The rate of change of mass fraction burned will be higher because the combustible mixture density will be higher at time of ignition. For the 40° B.T.D.C. spark timing curve, the timing is changed from 40° to 14° B.T.D.C., a change of about 25 degrees. The combustible mixture will be completely burned at a point closer to TDC, thus increasing efficiency.

The above arguments clearly illustrate the importance of an increase in spark volume for reduced emission and improved fuel economy. With the TSI system of the present invention, the required spark advance for maximum efficiency can be reduced by 20° to 30°, or more.

While increasing spark volume, the TSI system provides for moving the spark deeper into the combustion chamber, with the effect of reducing the combustion duration, which is critical to lean operation (Quader, A., "What Limits Lean Operation in Spark Ignition Engines—Flame Initiation or Propagation?", *SAE Paper* 760760 (1976)).

The construction of a practical TSI system will now be discussed for various embodiments of the invention.

The TSI system of the present invention includes of a small plasma gun, a traveling spark ignitor (also known as a TSI), that substitutes for a conventional spark plug, and further includes specially matched electric trigger circuitry. In the present invention, theoretical modeling plays an important role in the optimization and matching of the coaxial plasma gun and electrical circuit parameters. Matching the electric circuit to the parameters of the plasma gun (length of electrodes, diameters of coaxial cylinders, duration of the discharge) is necessary in order to maximize the volume of the plasma when it leaves the gun for a given store of electrical energy. By properly choosing the parameters of the electronic circuit it is possible to obtain current and voltage time profiles so that maximum electric energy is transferred to the plasma.

A design goal of the TSI ignition system of the present invention is to use no more than 300 mJ per firing. This represents less than 1% of the engine fuel required to propel the vehicle. Earlier plasma and Marshall gun ignitors have not achieved practical utility because they employed very large ignition energies (2–10 joules per firing) which causes rapid erosion of the ignitor, and short life. Further efficiency gains in engine performance were surrendered by increased ignition system energy consumption.

How can one achieve this TSI goal?

Heretofore, it had been thought that the proper design principle was to generate moving plasma with a very high speed, which would penetrate the combustible mixture to create a high level of turbulence and ignite a large volume of that mixture, and this was accomplished by using a relatively long length of electrodes with relatively small gap between them. For example, an aspect ratio of electrode length to discharge gap more than 3 and preferably 6–10 was proposed by Matthews et al, supra. In fact, In our invention, we propose to use a relatively short length of electrodes with relatively large gap between them, as is shown in equations (1) and (2) and is explained below and justified by theoretical calculations based on the plasma kinetic equations.

Consider that the kinetic energy of the plasma is proportional to the product of plasma mass, $M_p$, and its velocity, $v_p$ squared, as follows:

$$K.E.=M_p v_p^2 \quad (3)$$

Doubling the velocity of the plasma multiplies the kinetic energy by 4. The mass of plasma is $\rho_p \times Vol_p$ where $r_p$ and $Vol_p$ are the plasma density and plasma volume, respectively. Thus if we double the volume of the plasma at the same velocity we only double the required energy.

The thrust, then, of this invention is to maximize the ratio of plasma volume/energy required to form the plasma. This is done by quickly achieving a modest plasma velocity.

If one assumes a spherical shape for the ignition plasma volume, the surface area of the volume increases as the square of the radius of the volume. Ignition of the combustible mixture occurs at the surface of the plasma volume after the plasma has expanded and cooled to the combustible mixture ignition temperature. Thus the rate at which the combustible mixture burns initially depends primarily on the plasma volume and the plasma temperature and not on its initial velocity. Thus maximizing the ratio of plasma volume and temperature to plasma input energy, maximizes the effectiveness of the electrical input energy in speeding up the combustion of the combustible mixture.

The drag, D, on the expanding volume of plasma is proportional to the density of the combustible mixture, $\rho_c$, and the velocity squared of the expanding plasma are related as follows:

$$D \sim \rho_c v_p^2 \quad (4)$$

The electrical force, F, to expand the plasma is proportional to the discharge current squared. Equating these two forces yields the following:

$$F \sim I^2 = D \sim \rho_c v_p^2 \quad (5)$$

The radius of the plasma volume $Vol_p$ is proportional to $\int_0^{t_D} v_p(t)dt$ where $t_D$ is the duration of the discharge. The volume of the plasma is proportional to $r^3$, while the radius of the plasma volume is proportional to $\int_0^{t_D} I(t)dt = Q$, the electric charge inserted into the plasma. Thus the volume of the plasma is proportional to $Q^3$.

If the source of electric energy is that stored in a capacitor, then Q=VC, where V is the voltage at which the charge Q is stored, and C is the capacitance, and the energy stored in the capacitor is $E = \frac{1}{2} CV^2$.

To maximize the plasma volume for given energy the ratio of plasma volume to electric energy $Vol_p/E$ has to be maximized. $Vol_p/E$ is proportional to $C^3V^3/CV^2$, which is $C^2V$. For a given $E = \frac{1}{2} CV^2$=constant, C will be proportional to $V^{-2}$. Hence, $Vol_p/E$ is proportional to $V^{-3}$.

Therefore, the optimum circuit design is one which stores the electric energy in the largest capacitor at the lowest voltage.

The focus on efficiency enhancement, therefore, is to make the discharge take place at the lowest possible voltage. To that end the focus of the invention is firstly to cause the initial discharge of electrical energy to take place on the surface of an insulator, and to use a secondary power supply to efficiently and effectively raise the gap conductivity near surface of that insulator thus ensuring that the main source of discharge energy can be stored at the lowest possible voltage.

The second focus is to select a geometry and current discharge rate to create the largest volume of plasma at the highest temperature possible.

One element of this analysis leads to avoiding recombination of the large amount of ions and electrons of the traveling spark (plasma) on the electrode walls. The energy losses due to the recombination of ions and electrons reduce the efficiency of the system. Since recombination processes take time, the ion formation should take place quickly to minimize the probability of interaction of ions with the walls. To reduce recombination, therefore, the discharge time should be short. This can be achieved by a high plasma velocity and a short travel distance.

There is a second loss term, which is due to the drag force on the plasma as it impacts the combustible mixture ahead of its path. These losses vary as the square of the velocity.

To minimize both the recombination losses and drag losses, one needs to find a balance between velocity and travel distance.

This has been analyzed mathematically using plasma kinetic equations and the calculation show that an electrode length of about 2.5 mm, with an ignitor volume of about 100 $mm^3$, for an ignition energy of 300 millijoules provides a good balance of these requirements. Recognition of this problem and its optimum solution has not been shown in the prior art, to the knowledge and belief of the inventors. Nor do the inventors believe that this solution has been even inadvertently shown in prior art. Thus the present invention in its various embodiments can not be considered to be obvious to those skilled in the ignitor art.

The high volume that is desired, combined with the need to discharge quickly, leads to a structure characterized by a short length l for plasma travel with a relatively wide gap between electrodes. This requirement is specified geometrically by two ratios: in Eq. (1) for FIG. 2 and in equivalent Eq. (2) for FIG. 3.

What does this mean with respect to physical dimensions? If the volume of the plasma in a point to point discharge of a conventional spark plug is about 1 $mm^3$, the goal is to create a plasma volume at least 100 times greater, $Vol_p \approx 100$ $mm^3$. Thus, an example satisfying such conditions could be: length l=2.5 mm, the radius (inside) of the larger diameter cylindrical electrode being $r_2$=5.8 mm (this would be a typical radius of the cylindrical electrode using the conventional spark gap with a thread diameter of 14 mm) and the radius of the smaller diameter cylindrical electrode being $r_1$=4.6 mm.

As shown in the embodiments of FIGS. 2 and 3, TSI 17, 27, respectively, share many of the same physical attributes as a standard spark plug such as standard mounting threads 19, and standard male spark plug boot connector configurations 21, and insulator configurations 23. The tips or plasma forming portion of the TSI's 17 and 27, respectively, differ significantly. This is illustrated in FIG. 2., which shows a cross section of a Traveling Spark Ignitor (TSI) for one embodiment of the present invention. As shown, an internal electrode 18 (smaller diameter cylinder) is placed with a lower portion coaxially in the interior open volume of external electrode 20 (larger diameter cylinder). The space between the electrodes is filled with an insulating material 22 (e.g. ceramic) except for the last 2 to 3 mm, in this example, at the end of the ignitor 17, this distance being shown as l. The space or discharge gap $g_1$ between the electrodes has a radial distance of about 1.2 to about 1.5 mm, in this example. These distances for l and $g_1$ are important in that the TSI works as a system with the matching electronics (discussed below) in order to obtain maximum efficiency. A discharge between the electrodes 18 and 20 starts along the exposed interior surface of the insulator 23, since it requires a lower voltage to initiate a discharge along the surface of an insulator than in the gas away from the surface. The gas (air/fuel mixture) is ionized by the high electrical field and current of the discharge, creating a plasma 24 which becomes a good conductor of the current and permits an increased current flow. This increased current ionizes more gas (air/fuel mixture) and increases the volume of the plasma 24. In the TSI of FIG. 2, the plasma accelerates out of the "ignitor plug" 17 along the axial direction.

For the embodiment of FIG. 2, it was discovered that the relationship between the length of electrode 18 in the space forming discharge gap $g_1$ and the volume of the gap is important for efficient use of the electrical energy, as was discussed above.

FIG. 3 shows a TSI 27 with an internal electrode 25 (smaller diameter cylinder, in this example) that is placed coaxially in the external electrode 28 (larger diameter cylinder). The space between the electrodes 26 and 28 is filled with an insulating material 30 (e.g. ceramic). The main distinguishing feature for the embodiment of FIG. 3 relative to FIG. 2, is the flat, disk shaped electrode 26 formed or attached coaxially to the free end of the center electrode 25, perpendicular to the longitudinal axis of electrode 25. Note further that the horizontal plane of electrode 26 is parallel to the associated piston head when the plasma ignitor 27 is installed in a piston cylinder. As a result, an annular cavity 29 is formed between opposing surfaces of electrodes 26 and 28. More precisely, there are two substantially parallel surfaces of electrodes 26 and 28 spaced apart and oriented to be parallel to the top of an associated piston head, as opposed to previous plasma jet ignitors wherein the electrodes run perpendicular to an associated piston head. Consider that when the air/fuel mixture is ignited, the associated piston comes up and is close to the spark plug or ignitor 27, so that in terms of distance from gap 29 of the ignitor 27, the longest distance is to the wall of the associated cylinder, and not to the piston head. Accordingly, the preferred direction of travel for the plasma to obtain maximum interaction with the mixture is from the gap 29 to the cylinder wall. The essentially parallel electrodes 26 and 28 are substantially parallel to the longest dimension of the volume of the combustible mixture at the moment of ignition, instead of being oriented perpendicular to this dimension and toward the piston head as in the embodiment of FIG. 2, and of the prior art. Accordingly, the embodiment of FIG. 3 is a preferred embodiment of the invention. Note that it was discovered that under the same electrical conditions for energizing ignitors 17 and 27, the plasma acceleration lengths l and L, respectively, are the same for obtaining optimal plasma production. Also, for TSI 27, under these conditions the radius of the disc (external electrode) is $R_2$=6.8 mm, the radius of the isolating ceramic is $R_1$=4.3 mm the gap between the electrodes $g_2$=1.2 mm and the length L=2.5 mm.

With this orientation, in the preferred embodiment of FIG. 3, the plasma 32 initiates in discharge gap 29 at the exposed surface of insulator 25 surrounding center cylinder or electrode portion 25, and grows and expands outward in the radial direction. This provides several additional advantages over the TSI embodiment of FIG. 2. First, the surface area of the disk electrode 26 exposed to the plasma 32, is equal to that of the end portion of the outer electrode 28 exposed to the plasma 32. This means that the erosion of the inner portion of disk electrode 26 of TSI 27 of FIG. 3 can be expected to be significantly less than that of the exposed portion of inner electrode 18 of TSI 17 of FIG. 2, the latter having a much smaller surface area exposed to the plasma. Secondly, the insulator material 30 in the TSI 27 of FIG. 3 provides an additional heat sink path, since it comes up further than that in FIG. 2, and it contacts a larger area of electrode portions 25 and 26, compared to insulator material 22 relative to the exposed portion of electrode 18. Both the ample amount of insulator material 30, and larger contact area will keep the inner electrode metal 25, 26 cooler than electrode 18 in FIG. 2, thereby enhancing the reliability of TSI 27 relative to TSI 17. Finally, in using TSI 27, the plasma will not be impinging on and perhaps eroding the associated piston head.

Figure 5:
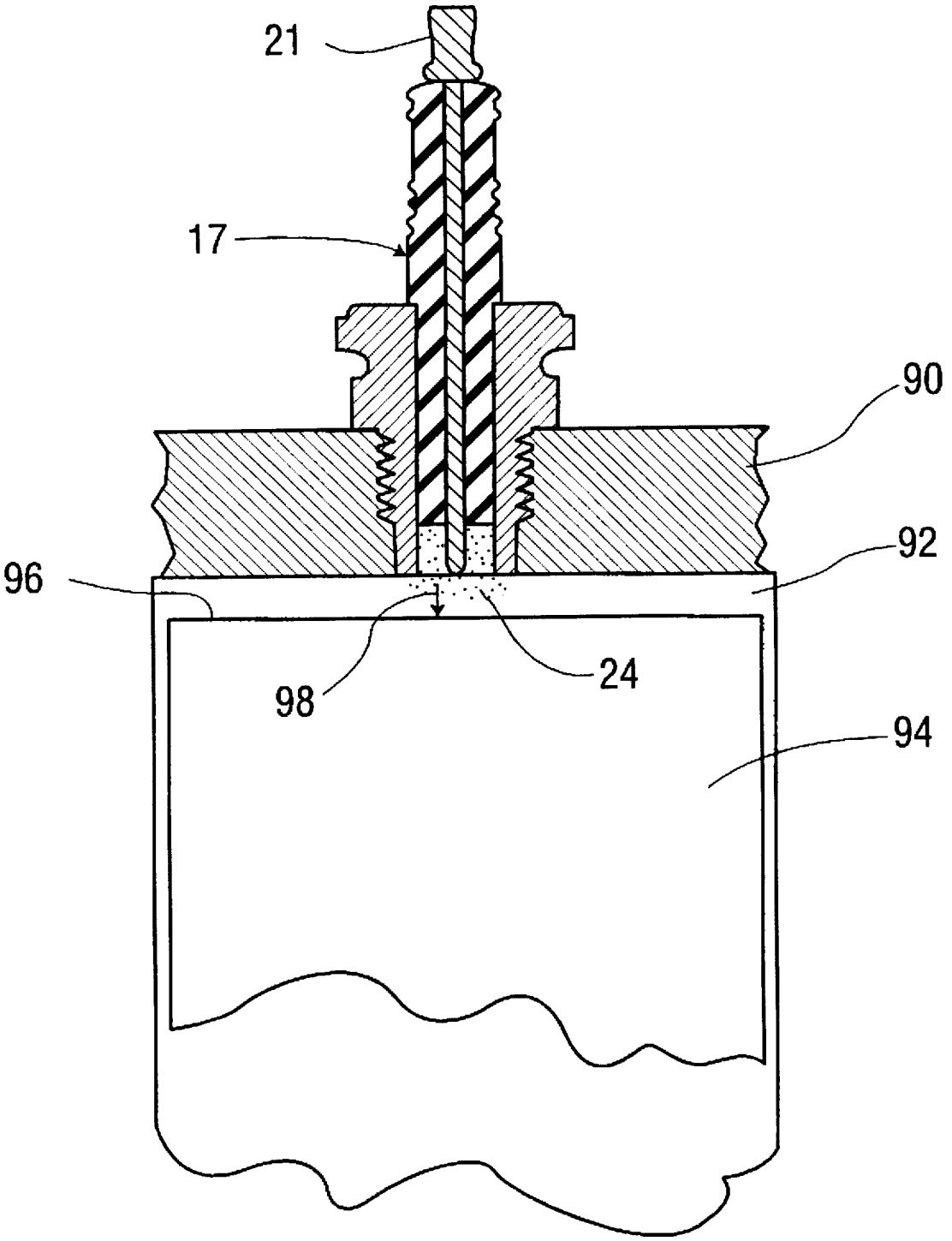
FIG. 5 is a cutaway pictorial view of a traveling spark ignitor for one embodiment of the invention, as installed into a cylinder of an engine.
Figure 6:
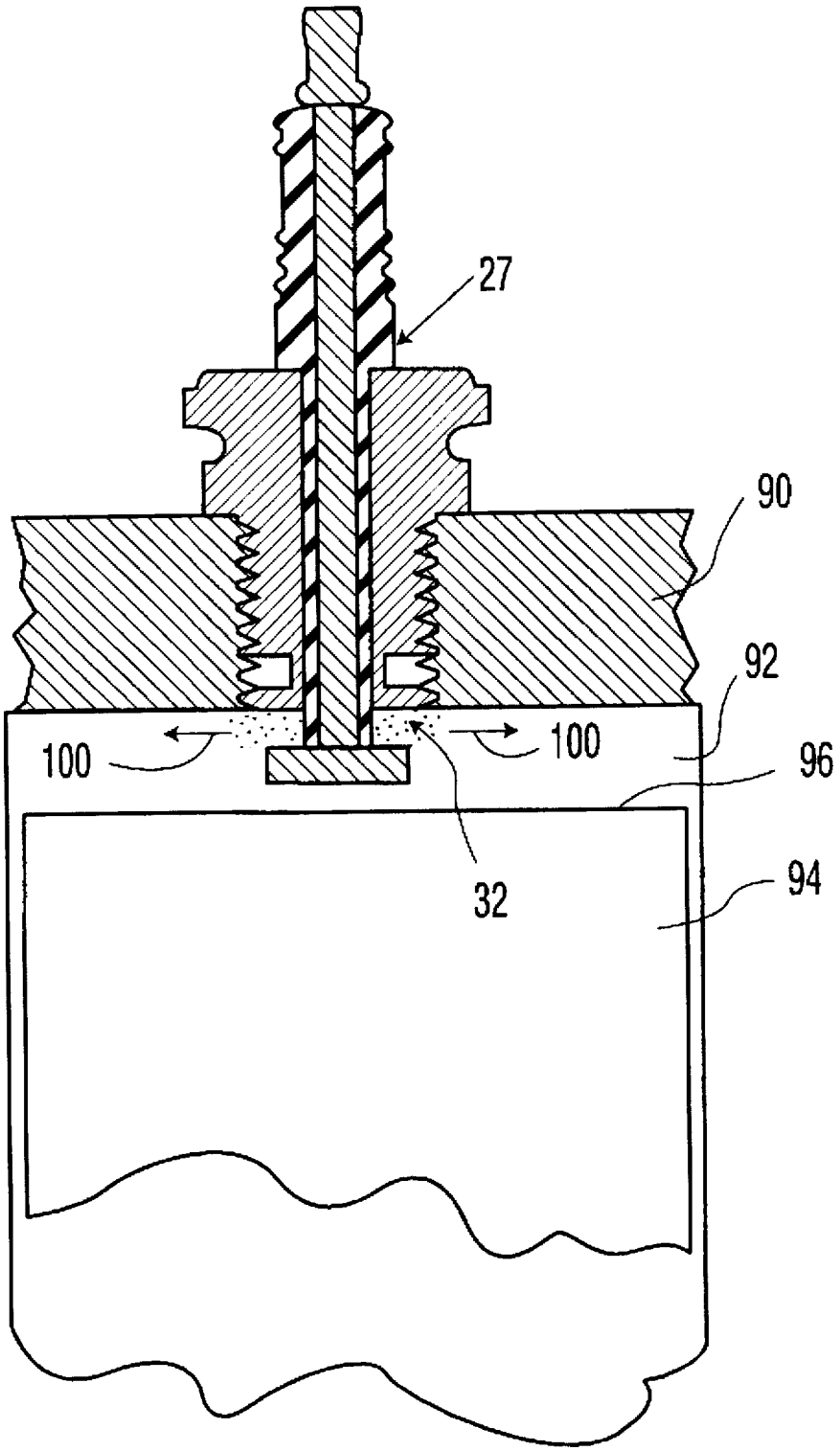
FIG. 6 is a cutaway pictorial view of a traveling spark ignitor preferred embodiment invention, as installed into a cylinder of an engine.

FIGS. 5 and 6 illustrate pictorially the differences in plasma trajectory between TSI 17 of FIG. 2, and TSI 27 of FIG. 3. In FIG. 5, a TSI 17 is mounted in a cylinder head 90, associated with a cylinder 92, and a piston 94 reciprocating or moving up and down in the cylinder 92. As in any conventional internal combustion engine, as the piston head 96 nears top dead center, the TSI 17 will be energized to produce the plasma 24, which will travel in the direction of arrow 98 only a short distance toward or to the piston head 96. During this travel, the plasma 24 will ignite the air/fuel mixture in the cylinder 92. The ignition begins in the vicinity of the plasma 24. Contrary to such travel of plasma 24, as shown in FIG. 6, the TSI 27 provided for the plasma 32 to travel in the direction of arrows 100, resulting in the ignition of a greater amount of air/fuel mixture than provided by TSI 17, as previously explained.

The materials of construction of the TSI 17 and TSI 27 are not particularly critical and the choice will be driven by economics, lifetime, marketing, erosion rates and the like. The electrode materials could be steel, clad metals, platinum-plated steel (for erosion resistance or "performance engines"), copper, and high-temperature electrode metals such as molybdenum or tungsten, for example. The metal may be of controlled thermal expansion like Kovar (Carpenter Technology Corp.) and coated with a material such as cuprous oxide so as to give good subsequent seals to glass or ceramics. Electrode materials may also be selected to reduce power consumption. For instance, thoriated tungsten could be used as its slight radioactivity may help to pre-ionize the air between the electrodes, possibly reducing the required ignition voltage. Also, the electrodes may be made out of high-Curie temperature permanent magnet materials, polarized to assist the Lorentz force in expelling the plasma.

The electrodes, except for a few millimeters at the end, are separated by an isolator or insulator material which is a high temperature, polarizable electrical dielectric. This material can be a porcelain, or a fired ceramic with a glaze, as is used in conventional spark plugs, for example. Alternatively, it can be formed of refractory cement, a machinable glass-ceramic such as Macor (Corning Glass Company), or molded alumina, stabilized zirconia or the like fired and sealed to the metal electrodes with a solder glass frit, for example. As above, the ceramic could also comprise a permanent magnet material such as barium ferrite.

In terms of operation of the embodiments of FIGS. 2 and 3, when the parallel electrodes 18, 20 and 25, 26, respectively, are connected to the rest of the TSI system, they become part of an electrical system which also comprises an electrical circuit for providing potential differences which are sufficiently high to create a spark in the gap between at least two electrodes. The resulting magnetic field surrounding the current flowing through the electrodes and in the spark channel, for each embodiment of the invention, interacts with the electrical field to create a Lorentz force on the spark channels which causes the point of origin of the spark channel to move, and not to remain fixed in position, thus increasing the cross sectional area of the spark channels, as previously described. This is in contrast to traditional spark ignition systems, wherein the point of origin of the spark remains fixed. Electrical circuits matched to the TSIs 17 and 27 complete the TSI system for each embodiment, and are discussed in the following examples.

EXAMPLE 1

Figure 4:
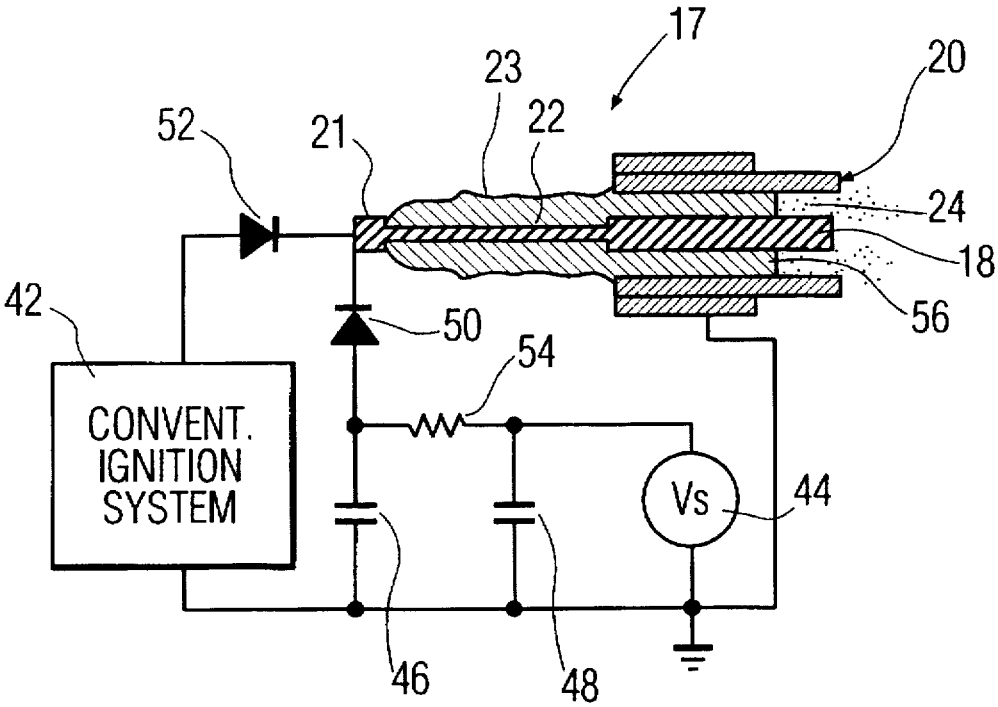
FIG. 4 illustrates one embodiment of the invention for a TSI system.

FIG. 4 shows a TSI plug or ignitor 17 with a schematic of the basic elements of an electric circuit connected thereto, which supplies the voltage and current for the discharge (plasma). A discharge between the two electrodes 18 and 20 starts along the surface 56 of the insulator material 22, since it is easier to initiate a discharge along the surface of an insulator than in the gas away from the surface. The gas (air/fuel mixture) is ionized by the current of the discharge, creating a plasma 24 which becomes a good conductor of the current and permits an increased current flow. This increased current ionizes more gas (air/fuel mixture) and increases the volume of the plasma 24.

The electrical circuit shown in FIG. 4 includes a conventional ignition system 42 (e.g. capacitive discharge ignition, CDI, or transistorized coil ignition, TCI), a low voltage ($V_s$) supply 44, capacitors 46, 48, diodes 50, 52, and a resistor 54. The conventional ignition system 42 provides tile high voltage necessary to break down or ionize the air/fuel mixture in the gap along the surface 56 of the TSI plug 17. Once the conducting path has been established, the capacitor 46 quickly discharges, providing a high power input or current into the plasma 24. The diodes 50 and 52 are necessary to electrically isolate the ignition coil (not shown) of the conventional ignition system 42 from the relatively large capacitor 46 (between 1 and 4 μF). If the diodes 50, 52 were not present, the coil would not be able to produce a high voltage due to the low impedance provided by capacitor 46. The coil would instead charge the capacitor 46. The function of the resistor 54, the capacitor 48, and the voltage source 44 is to in combination recharge the capacitor 46 after a discharge cycle. The resistor 54 is one way to prevent a low resistance current path between the voltage source 44 and the spark gap of TSI 17.

Note that the circuit of FIG. 4 is simplified, for purposes of illustration. In a commercial application, the circuit of FIG. 7 described below in Example 2 is preferred for recharging capacitor 46 in a more energy efficient manner, e.g. by a resonant circuit. Furthermore, the conventional ignition system 42, whose sole purpose is to create the initial breakdown, is modified so as to use less energy and to discharge more quickly. Almost all of the ignition energy is supplied by capacitor 46. The modification is primarily to reduce high voltage coil inductance by the use of fewer secondary turns. This is possible because the initiating discharge can be of a much lower voltage when the discharge occurs over an insulator surface. The voltage required can be about ⅓ that required to cause a gaseous breakdown in air.

The current through the central electrode 18 and the plasma 24 to the external electrode 20 creates around the central electrode 18 a poloidal (angular) magnetic field $B_T$ (I, r), which depends on the current and distance from the axis of cylinder (radius $r_o$: see FIG. 1). Hence, the current I flowing through the plasma 24 perpendicular to the poloidal magnetic field $\vec{B}$ generates a Loreritz force $\vec{F}$ on the charged particles in the plasma 24 along the axial direction Z of the cyclinders 18, 20. The force is computed as follows in equation (6):

$$\vec{F} \sim \vec{I} \times \vec{B} \rightarrow F_z \sim I_r \cdot B_\theta \tag{6}$$

This force accelerates the charged particles, which due to collisions with non-charged particles accelerate all the plasma (see Chen, F. F., "Introduction to Plasma Physics", New York: *Plenum Press*, (1974)). Note that the plasma consists of charged particles (electrons and ions), and neutral atoms. The temperature is not sufficiently high in the discharge to fully ionize all atoms.

The original Marshall guns as a source of plasma for fusion devices were operated in a vacuum with a short pulse of gas injection between the electrodes. The plasma created between the electrodes by the discharge of a capacitor was accelerated in a distance of a dozen centimeters to a final velocity of about $10^7$ cm/sec. The plasma gun used as an engine spark plug operates at relatively high gas (air/fuel mixture) pressure. The drag force $F_v$ of such a gas is approximately proportional to a square of the plasma velocity, as shown below:

$$F_v \sim V_p^2 \tag{7}$$

The distance over which the plasma accelerates is short (2–3 mm). Indeed, experimentation showed that increasing the length of the plasma acceleration beyond 2–3 mm does not increase significantly the plasma exit velocity, although electrical energy stored in the capacitor 46 has to be increased significantly. At atmospheric pressures and for driving energy of about 300 mJ, the average velocity is close to $5\times10^4$ cm/sec and will be lower at higher pressure in the engine. At a compression ratio of 8:1, this average velocity will be approximately $3\times10^4$ cm/sec.

The dramatic difference in the plasma created by the plasma plug 17 over that created by a conventional spark plug was demonstrated photographically. The electrical energy input for both the plasma plug 17 and a conventional spark plug was equated to about 300 mJ. However, the resultant light emitted from the spark of a single conventional spark was too feeble to obtain a good photograph. Thirty (30) discharges were used by the inventors to create a photograph of the conventional spark as opposed to one discharge for photographing the plasma produced by the TSI plug or ignitor 17 and the calculated volume of the TSI plasma based on obtained images was more than 100 times larger than one in a conventional spark.

If more energy is put into a single discharge of the conventional spark, its intensity is increased somewhat, but the volume of the plasma created does not increase significantly. In a conventional spark, a much larger fraction of the energy input goes into heating the electrodes, because the discharge takes place over a much longer time (typically up to 1 millisecond).

EXAMPLE 2

Figure 7:
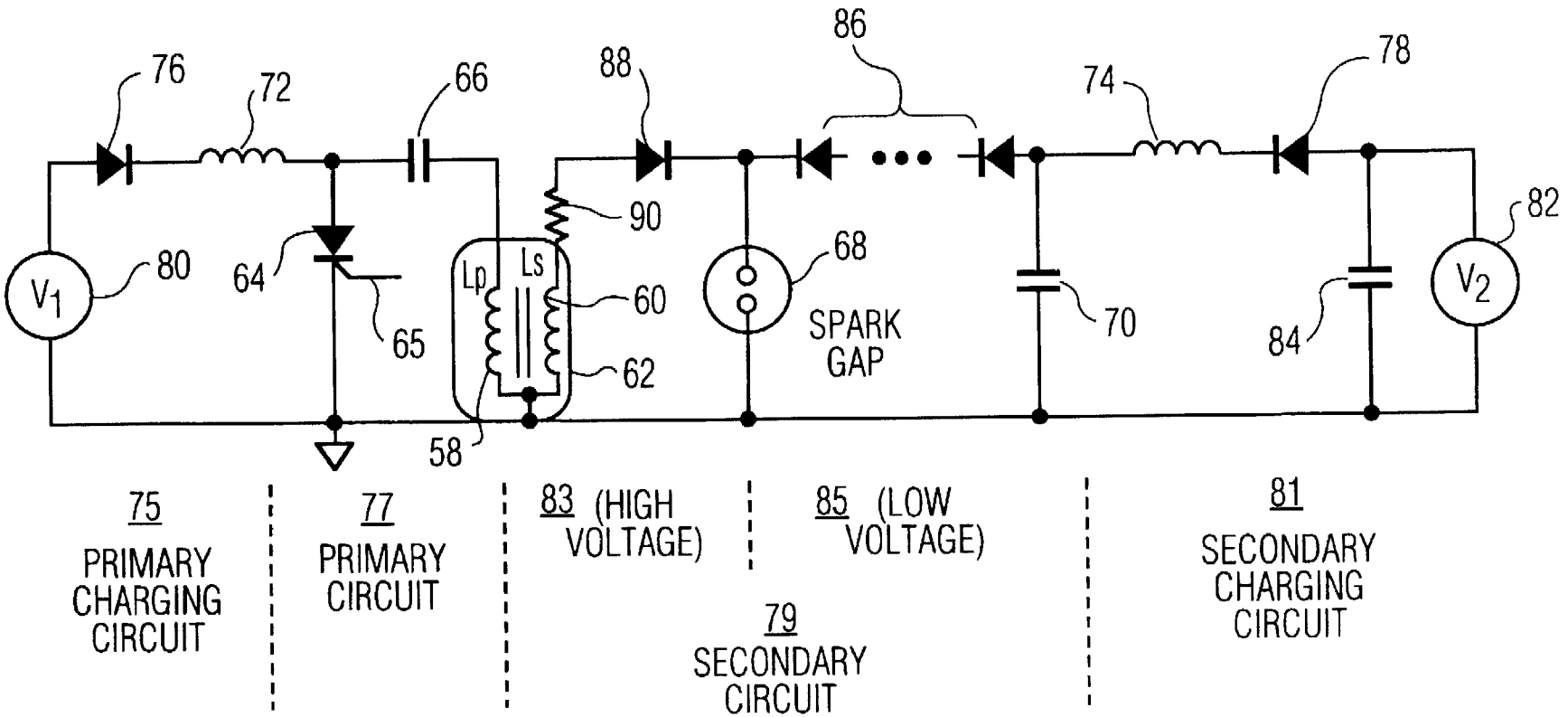
FIG. 7 shows a circuit schematic diagram for another embodiment of the invention for the TSI system.

TSI ignitors 17 and 27 of FIGS. 2 and 3, respectively can be combined with the ignition electronics described in FIG. 7. The ignition electronics can be divided into four parts, as shown in the primary and secondary circuits 77, 79, respectively, and their associated charging circuits 75, 81, respectively. The secondary circuit 79, in turn, is divided into a high voltage section 83, and a low voltage section 85.

The primary and secondary circuits 77, 79, respectively, correspond to primary 58 and secondary 60 windings of an ignition coil 62. When the SCR 64 is turned on via application of a trigger signal to its gate 65, the capacitor 66 discharges through the SCR 64, which causes a current to flow in the coil primary winding 58. This in turn imparts a high voltage across the associated secondary winding 60, which causes the gas in the spark gap 68 to break down and form a conductive path, i.e. a spark or plasma. Once the plasma has been created, the secondary capacitor 70, discharges. The spark gap 68 circuit element is representative of the ignitors or TSI devices 17 and 27 of FIGS. 2 and 3, respectively.

After the primary winding 58 and secondary capacitor 70 have discharged, they are recharged by their respective charging circuits 75 and 81. Both charging circuits 75, 81 incorporate an inductor 72, 74 and a diode 76, 78, together with a power supply 80, 82, respectively. The function of the inductors 72, 74 is to prevent the power supplies from discharging through the ignitor. The function of the diodes 76 and 78 is to avoid oscillations. The capacitor 84 prevents the power supply 82 voltage $V_2$ from going through large fluctuations.

The power supplies 80 and 82 both supply on the order of 500 volts or less for voltages $V_1$ and $V_2$, respectively. They could be combined into one power supply. In experiments conducted by the inventors these power supplies were kept separate to make it easier to vary the two voltages independently. Power supplies 80 and 82 are DC-to-DC converters from a CDI (capacitive discharge ignition) system, which can be powered by a 12 volt car battery.

An essential part of the ignition circuit of FIG.7 are high current diodes 86, which have a high reverse breakdown voltage, larger than the maximum spark gap breakdown voltage of either TSI 17 or TSI 27 for all engine operating conditions. The function of the diodes 86 is to isolate the secondary capacitor 70 from the ignition coil 62, by blocking the flow of current from secondary winding 60 to capacitor 70. If this isolation were not present, the secondary voltage of ignition coil 62 would charge the secondary capacitor 70, and, given a large capacitance, the ignition coil 62 would never be able to develop a sufficiently high voltage to break down the spark gap 68.

Diode 88 prevents capacitor 70 from discharging through the secondary 60 when there is no spark or plasma. Finally, the resistor 90 is used to reduce current flow through secondary winding 60, thereby reducing electromagnetic radiation (radio noise) emitted by the circuit.

In the present TSI system, a trigger electrode can be added between the inner and outer electrodes of FIGS. 2 through 4 to lower the voltage on capacitor 70 in FIG. 7. Such a three electrode ignitor is shown in FIG. 8, and is described in the following paragraph.

Figure 8:
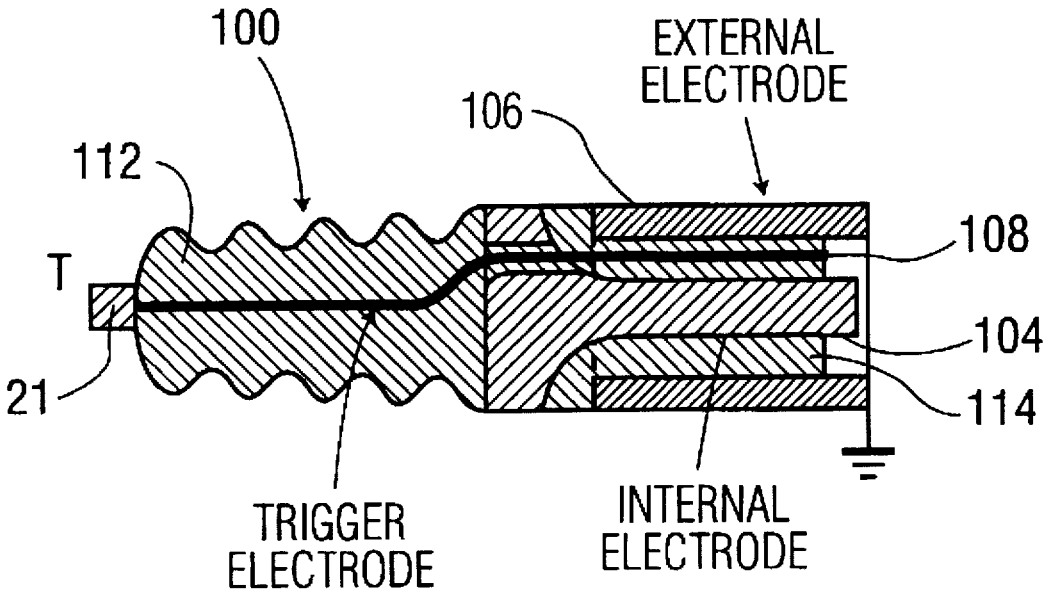
FIG. 8 shows a cross sectional view of yet another traveling spark ignitor for an embodiment of the invention.

In FIG. 8, a three electrode plasma ignitor 100 is shown schematically. An internal electrode 104 (smaller diameter cylinder) is placed coaxially in the external electrode 106 (larger diameter cylinder), both in the order of several millimeters. Between the internal electrode 104 and the external electrode 106 is a third electrode 108 (thin wire). This third electrode 108 is connected to a high voltage (HV) coil. The third electrode 108 initiates a discharge between the two main electrodes 104 and 106 by charging the exposed surface 114 of the insulator 112. The space between all three electrodes 104, 106, 108 is filled with insulating material 112 (e.g. ceramics) except for the last 2–3 mm space between electrodes 104 and 106 at the combustion end of the ignitor 100. A discharge between the two main electrodes 104 and 106, after initiation by the third electrode 108, starts along the surface 114 of the insulator 112. The gas (air-fuel mixture) is ionized by the current of the discharge. This discharge creates a plasma, which becomes a good electrical conductor and permits an increase in the magnitude of the current. The increased current ionizes more gas (air-fuel mixture) and increases the volume of the plasma, as previously explained.

The high voltage between the tip of the third electrode 108 and the external electrode 106 provides a very low current discharge, which is sufficient to create enough charged particles on the surface 114 of the insulator 112 for the main capacitor to discharge between electrodes 104 and 106 along surface 104 of dielectric or insulator 112.

Figure 9A:
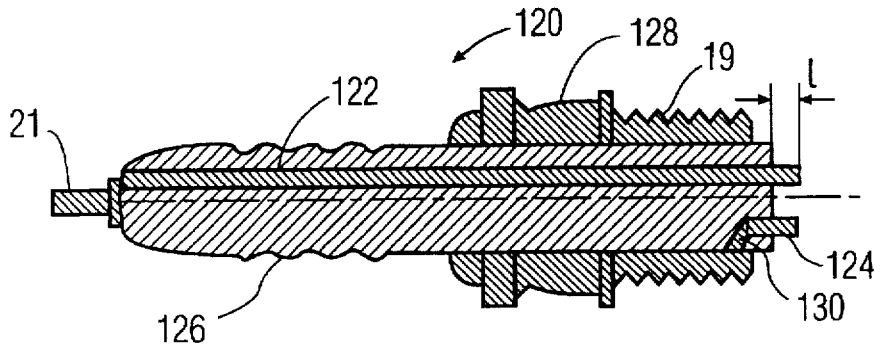
FIG. 9A shows a longitudinal cross sectional view of another traveling spark ignitor for another embodiment of the invention.
Figure 9B:
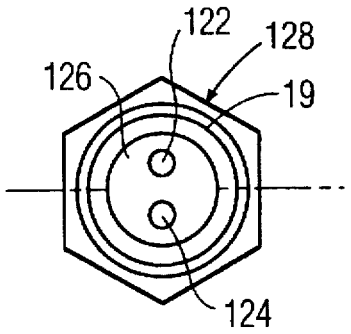
FIG. 9B is an end view of the traveling spark ignitor of FIG. 9A including the free ends of opposing electrodes.
Figure 9C:
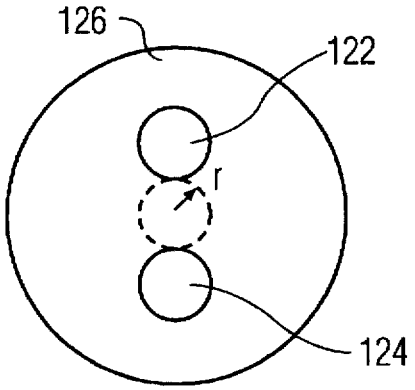
FIG. 9C is an enlarged view of FIG. 9B.

As shown in FIGS. 9A, 9B, and 9C, another embodiment of the invention includes a traveling spark ignitor 120 having parallel electrodes 122 and 124, as shown. The parallel electrodes 122,124 have a substantial portion of their respective lengths encapsulated by dielectric insulator material 126, as shown. A top end of the dielectric 126 retains a spark plug boot connector 21 that is both mechanically and electrically secured to the top end of electrode 122. The dielectric material 126 rigidly retains electrodes 122 and 124 in parallel, and a portion rigidly retains the outer metallic body 128 having mounting threads 19 about a lower portion, as shown. Electrode 124 is both mechanically and electrically secured to an inside wall of metallic body 128 via a rigid strap 130, as shown, in this example. As shown in FIG. 9A, each of the electrodes 122 and 124 extend a distance l outward from the surface of the bottom end of dielectric 126.

With reference to FIGS. 9B and 9C, the electrodes 122 and 124 are spaced apart a distance 2r, where r is the radius of the largest cylinder that can fit between the electrodes 122, 124 (see FIG. 2C).

Although various embodiments of the invention are shown and described herein, they are not meant to be limiting. Those of skill in the art may recognize various modifications to the embodiments, which modifications are meant to be covered by the spirit and scope of the appended claims. For example, the electrodes 18 and 20 of TSI 17, and 25 of TSI 27 can be other than cylindrical. Also, the disk shaped electrode 26 can be other than circular-a straight rod, for example. For TSI 17, the electrodes 18 and 20 may also be other than coaxial, such as parallel rods or parallel elongated rectangular configurations.

What we claim is:

1. A traveling spark ignition (TSI) system for a combustion engine, comprising:

an ignitor including:

parallel and spaced apart electrodes, including at least first and second electrodes forming a discharge gap between them, wherein the ratio of the sum of the radii of said electrodes to the length of the said electrodes is larger than or equal to 4, while the ratio of the difference of these two radii to the length of the said electrodes is larger than ⅓;

polarizable ceramic material surrounding a substantial portion of said electrodes and the space between said electrodes;

an uninsulated end portion of each of said electrodes being free of said polarizable ceramic material and in oppositional relationship to one another;

means for housing said first and second electrodes and associated said polarizable ceramic material, including means for mounting said ignitor with said free ends of said first and second electrodes installed in a combustion cylinder of said engine;

electrical means for providing a potential difference between said electrodes for initially providing thereto a sufficiently high first voltage for creating a channel formed of plasma between said electrodes, and thereafter a second voltage of lower potential than said first voltage, for sustaining a flow of current through the plasma in said channel between said electrodes, whereby an electric field from the potential difference between said electrodes and said magnetic field interact in a manner creating a force upon said plasma for causing it to move away from its points of origin, thereby substantially increasing the volume of said plasma.

2. The TSI system of claim 1, wherein said electrical means includes:

a first voltage source for providing said first voltage having a relatively high amplitude but low magnitude of current; and a second voltage source for providing said second voltage of substantially lower amplitude but with higher magnitude of current relative to said first voltage source.

3. The TSI system of claim 1, further including:

said ignitor further including a third electrode located between said first and second electrodes; and said first voltage is applied between said second and third electrodes, and said second voltage is applied between said first electrode and said second electrode.

4. The TSI system of claim 1, wherein said parallel first and second electrodes are parallel planar surfaces.

5. The TSI system of claim 1, wherein said parallel first and second electrodes are one or more pairs of parallel cylinders.

6. The TSI system of claim 1, wherein the axial length of the uninsulated portion of the first and second electrodes is smaller than or equal to 3 mm and the radial separation of the electrodes is from about 1 mm to about 3 mm.

7. The TSI system of claim 1, wherein said parallel first and second electrodes are parallel to the longitudinal axis of said ignitor.

8. The TSI system of claim 1, wherein uninsulated surfaces of the said parallel first and second electrodes that face each other are of the form of annular sections of disks oriented in a plane perpendicular to a longitudinal axis of said ignitor.

9. The TSI system of claim 8, wherein the radial width of said uninsulated part of annular disks is smaller or equal to 3 mm and the separation of the electrodes is about 1 mm to about 3 mm.

10. A traveling spark ignition (TSI) system for a combustion engine, comprising:

an ignitor including:

two parallel and spaced apart electrodes adapted for forming discharge gaps between them, wherein the radius of the largest cylinder which can fit between said electrodes is greater than the length of said electrodes;

polarizable ceramic material surrounding a substantial portion of said electrodes and the space between said electrodes;

an uninsulated end portion of each of said electrodes being free of said polarizable ceramic material and in oppositional relationship to one another, sand uninsulated end portion being designated the length of said electrodes, respectively;

means for housing said electrodes and associated said polarizable ceramic material, including means for mounting said ignitor with said free ends of said electrodes in a combustion cylinder of said engine; and electrical means for sequentially providing two potential differences between said electrodes, the first potential difference applied being sufficiently high for creating a channel formed of plasma between said electrodes, and thereafter the second voltage applied of lower potential than said first voltage, for sustaining a flow of current through the plasma in said channel between said electrodes, whereby an electric field caused by the potential difference between said electrodes, and a magnetic field surrounding said current, interact in a manner creating a force upon said plasma for causing it to move away from its points of origin, thereby substantially increasing the swept area of said plasma.

* * * * *